US008251454B2

(12) United States Patent
Tsukiji et al.

(10) Patent No.: US 8,251,454 B2
(45) Date of Patent: Aug. 28, 2012

(54) BACKREST OF THE CHAIR AND ADAPTATION DEVICE FOR THE SAME

(75) Inventors: Hiroaki Tsukiji, Yokohama (JP); Eisuke Hara, Yokohama (JP)

(73) Assignee: Okamura Corporation, Kanagawa (JP)

( * ) Notice: Subject to any disclaimer, the term of this patent is extended or adjusted under 35 U.S.C. 154(b) by 168 days.

(21) Appl. No.: 12/740,813

(22) PCT Filed: Oct. 28, 2008

(86) PCT No.: PCT/JP2008/069506

§ 371 (c)(1),
(2), (4) Date: May 21, 2010

(87) PCT Pub. No.: WO2009/057579

PCT Pub. Date: May 7, 2009

(65) Prior Publication Data

US 2010/0237679 A1 Sep. 23, 2010

(30) Foreign Application Priority Data

Nov. 2, 2007 (JP) ..... 2007-286300
Nov. 2, 2007 (JP) ..... 2007-286301
Nov. 2, 2007 (JP) ..... 2007-286631
Jan. 24, 2008 (JP) ..... 2008-013498

(51) Int. Cl.

| | |
|---|---|
| ***A47C 7/02*** | (2006.01) |
| ***A47C 7/40*** | (2006.01) |
| ***A47C 7/42*** | (2006.01) |
| ***A47C 7/44*** | (2006.01) |
| ***A47C 31/11*** | (2006.01) |

(52) U.S. Cl. ..... 297/452.18; 297/219.1; 297/223; 297/224; 297/228.1; 297/452.13; 297/452.56; 297/440.2; 297/440.21

(58) Field of Classification Search ..... 297/219.1, 297/223, 224, 228.1, 228.11, 228.12, 228.13, 297/452.13, 452.56, 440.2, 440.21, 452.18
See application file for complete search history.

(56) References Cited

U.S. PATENT DOCUMENTS 4,580,840 A * 4/1986 Cunningham et al. ... 297/452.56 X (Continued)

FOREIGN PATENT DOCUMENTS

EP 0 922 419 A2 6/1999

(Continued)

OTHER PUBLICATIONS

International Search Report, PCT/JP2008/069506, Nov. 25, 2008.

(Continued)

*Primary Examiner* — Rodney B White
(74) *Attorney, Agent, or Firm* — McKee, Voorhees & Sease, P.L.C.

(57) ABSTRACT

A backrest of chair in which the lower part of a back frame can be concealed neatly by a stretching material. In the backrest device of a chair where a bag like stretching material (12) knitted or woven in the shape of mesh and opening downward is stretched across a back frame (11) formed by coupling the upper ends of right and left side frames (14*a*) directing the vertical direction by an upper frame (14*b*) directing the right and left direction, and coupling the lower ends of both the side frames (14*a*) by a lower frame (14*c*) which can be fixed to a backrest supporting rod (8) erected from the upper rear of the seat body of the chair, upper portion of the stretching material (12) is made air permeable, and at least a part at the lower portion of the stretching material (12) covering the lower frame (14*c*) is made non-translucent.

4 Claims, 6 Drawing Sheets

U.S. PATENT DOCUMENTS

| | | | | |
|---|---|---|---|---|
| 5,393,126 | A * | 2/1995 | Boulva | 297/452.56 |
| 5,533,789 | A * | 7/1996 | McLarty et al. | 297/452.56 X |
| 5,560,683 | A * | 10/1996 | Penley et al. | 297/452.56 |
| 5,615,928 | A * | 4/1997 | Penley | 297/452.56 |
| 5,735,578 | A * | 4/1998 | Penley | 297/452.56 X |
| 6,220,661 | B1 * | 4/2001 | Peterson | 297/440.2 X |
| 6,371,555 | B1 * | 4/2002 | Edwards et al. | 297/228.1 |
| 6,382,719 | B1 * | 5/2002 | Heidmann et al. | 297/228.1 |
| 6,425,637 | B1 * | 7/2002 | Peterson | 297/452.56 X |
| 6,478,381 | B1 * | 11/2002 | Cramb et al. | 297/452.13 |
| 6,499,801 | B1 * | 12/2002 | Peterson et al. | 297/228.13 |
| 6,508,509 | B2 * | 1/2003 | Peterson | 297/440.2 X |
| 6,811,215 | B2 * | 11/2004 | Horiki et al. | 297/228.1 |
| 6,814,412 | B2 * | 11/2004 | Cramb et al. | 297/452.13 |
| 6,860,561 | B2 * | 3/2005 | Takata | 297/452.56 X |
| 6,983,997 | B2 * | 1/2006 | Wilkerson et al. | 297/452.56 |
| 7,144,084 | B2 * | 12/2006 | Edwards et al. | 297/452.18 |
| 7,216,936 | B2 * | 5/2007 | Peterson | 297/440.2 |
| 7,270,378 | B2 * | 9/2007 | Wilkerson et al. | 297/452.56 |
| 7,350,861 | B2 * | 4/2008 | Zaharakos | 297/228.1 |
| 7,517,024 | B2 * | 4/2009 | Cvek | 297/452.13 |
| 7,604,298 | B2 * | 10/2009 | Peterson et al. | 297/440.2 |
| 7,686,399 | B2 * | 3/2010 | Heidmann et al. | 297/452.56 X |
| 2002/0060493 | A1 * | 5/2002 | Nishino et al. | 297/452.56 |
| 2003/0122413 | A1 * | 7/2003 | Cramb et al. | 297/452.56 |
| 2003/0168901 | A1 * | 9/2003 | Wilkerson et al. | 297/452.56 |
| 2006/0103196 | A1 * | 5/2006 | Zaharakos | 297/228.1 |
| 2006/0138849 | A1 * | 6/2006 | Wilkerson et al. | 297/452.56 |
| 2007/0145797 | A1 * | 6/2007 | Itakura | 297/228.1 |
| 2007/0216213 | A1 * | 9/2007 | Chang | 297/452.13 |
| 2007/0267905 | A1 * | 11/2007 | Cvek | 297/452.56 X |
| 2008/0122274 | A1 * | 5/2008 | Edwards | 297/228.12 |
| 2008/0122284 | A1 * | 5/2008 | Yang | 297/452.56 |

FOREIGN PATENT DOCUMENTS

| | | | |
|---|---|---|---|
| JP | 2002-165672 | A | 6/2002 |
| JP | 2002-264709 | A | 9/2002 |
| JP | 2003-070592 | A | 3/2003 |
| JP | 2003-70592 | A | 3/2003 |
| JP | 2003-510115 | A | 3/2003 |
| JP | 2004-033542 | A | 2/2004 |
| JP | 2004-33542 | A | 2/2004 |
| JP | 2004-248839 | A | 9/2004 |
| JP | 2004-351118 | A | 12/2004 |
| JP | 2005-103047 | A | 4/2005 |
| JP | 2006-42848 | A | 2/2006 |
| JP | 2006-042848 | A | 2/2006 |
| JP | 2006-110000 | A | 4/2006 |
| WO | WO 02/098261 | A1 | 12/2002 |
| WO | WO 2004/037046 | A1 | 5/2004 |

OTHER PUBLICATIONS

English translation of Abstract for JP 2004-248839.
English Translation of Abstract for JP 2006-110000.
English Translation of Abstract for JP 2006-042848.
English Translation of Abstract for JP 2004-033542.
5 English Translation of Abstract for JP 2002-264709.
English Translation of Abstract for JP 2004-351118.
English Translation of Abstract for JP 2002-165672.
English Translation of Abstract for JP 2005-103047.
English Translation of Abstract for JP 2003-070592.
English Translation of Abstract for JP 2003-510115.
Okamura Corporation, EP 08 84 5068, Supplemental European Search Report, 2 pages, Mar. 3, 2011.

* cited by examiner

BACKREST OF THE CHAIR AND ADAPTATION DEVICE FOR THE SAME

TECHNICAL FIELD

The present invention relates to a backrest of the chair and an adaptation device for adapting this backrest to the back rest support poles.

RELATED ART

EP0922419A2 discloses, for example, a backrest of the chair where, on one hand, upper ends of side frames both extending in the upward/downward direction are linked mutually via an upper frame extending laterally and, on the other hand, lower ends of the side frames are linked mutually via a lower frame suited to be fixed to a seat, thereby allowing a baggy stretchable backrest cushion, which is inverted to open downwardly, to fit enclosingly over an entire back frame body in a rectangular shape viewed from the front side (see FIGS. 3 to 6).

JP2004-248839A discloses, for example, an adaptation device for adapting a backrest cushion to backrest support poles extending upward from a back side of a seat

PROBLEM TO BE SOLVED BY THE INVENTION

With regard to a stretchable backrest cushion adapted to fit over an entire back frame body, it is general to employ the mesh type one with relatively greater density, of which portion for supporting a user's back is allowed to bend backward suitably, such as the one described in above EP0922419A2.

Such a mesh type backrest cushion is translucent as a whole. Further, its lower frame has a complicated shape such that it may be fixed to backrest support poles and the like. Subsequently, it appears to be messy from sight.

In a backrest of the chair with a stretchable backrest cushion, the extent of backward bending at an upper portion of the backrest cushion for supporting a user's upper back is preferred to be greater than that at a lower portion for supporting his lower back so that the chair can be comfortable in case of his reclining to the backrest.

On the contrary, in case that a mesh type backrest cushion with wholly equal density is fitted to a rectangular back frame body as described in above EP0922419A2, the upper portion of the backrest cushion bends too backward, while the lower portion bends adequately. On the other hand, the lower portion of the backrest cushion bends too backward, while the upper portion bends adequately. In other words, in both cases, the chair is not comfortable to sit on.

Furthermore, in case that a user reclines to the baggy backrest cushion in such a manner as to bend its front part backwards, the front part is so close to the back part that the front part abuts to the back part and bends backwards therewith.

This prevents the front part of the backrest cushion from bending backward sufficiently whereas the user reclines to the backrest cushion. As a result, his back is not supported softly, thus causing him to feel uncomfortable to sit on.

Additionally, in a conventional backrest of the chair described in EP0922419A2 as above mentioned and JP2006-110000A, the whole backrest is made of hard material. Accordingly, in case that the backrest cushion, which enclosingly covers the side frames of the backrest, frictions other fixtures and/or collides therewith, these fixtures and/or the backrest cushion happen to be damaged.

In the backrest of the chair as described in the aforementioned JP2004-248839A, a connection block is fitted and fixed to a recess disposed in a lower back surface of the back plate, which opens backward and downward. Further, the right and left backrest support poles and their connection plate are fitted from downside to a fitting groove formed in the connection block. Thus, both backrest support poles are attached to the lower ends of the back frame body while an entire back frame body is covered with a cover cushion.

Therefore, even in the backrest of the chair as described in the aforementioned JP2004-248839A, in case that a mesh type stretchable backrest cushion with relatively great density is employed as a cover cushion, it is inevitable for inner elements such as a recess, the connection block, an attachment portion of the backrest support poles and the like to be seen from sight, thereby worsening the appearance.

In the attachment device for the backrest as described in the aforementioned JP2004-248839A, a fitting hole and a fitting groove are formed in a resin connection block so as to receive the backrest support poles and the connection plate fixed to them. Additionally, an integrally extended portion is formed to protrude downward from a lower end of the connection block. Further, a hook adapted to interlock with the connection plate for the backrest support poles is formed to be integral with a front surface of this extended portion. Consequently, the connection block becomes complicated, thereby causing a die for molding it to be also complicated and production costs to increase.

Disclosure of the Invention

The present invention has been made in consideration of the foregoing defects. The first object of the present invention is to hide a lower part of back frame body neatly by a stretchable backrest cushion and to allows upper and lower parts of a baggy stretchable backrest cushion to bend backwards differently and adequately, thereby maximizing the backward bending of a front portion of the backward cushion and thus permitting a chair furnished with this backrest cushion to be comfortable to sit on. In relation to this, the present invention prevents the backrest from damaging other fixtures and/or the backrest cushion from damaging itself. The second object of the present invention is to provide an adaptation device for the backrest of a chair where its connection member for connecting a back rest support pole with a back frame body has a simple structure with the aim of lowering production costs and reducing the number of steps for assembling.

Means to Solve the Problem

To achieve the first object, the present invention provides a backrest of the chair, preferably in substantially rectangular shape, comprising: a back frame including: right and left side frames extending in the upward/downward direction; an upper frame extending laterally and linking upper ends of the side frames to each other; and a lower frame attaching lower ends of the side frames to a backrest support adapter protruding upward from a rear part of a seat body in the chair; and a baggy stretchable backrest cushion which is inverted to open vertically and is knitted mesh-like or woven, characterized in that an upper part of the backrest cushion is air permeable; and that at least part of the lower backrest cushion covering the lower frame is non-translucent.

The backrest cushion in this backrest of the chair is translucent at least in its lower part covering the lower frame of the back frame. Thus, this backrest provides better appearance because the lower frame is enclosed by the lower backrest cushion to be hidden from sight.

Additionally, the upper backrest cushion is air permeable, thereby preventing a user to feel sweaty at his back.

It is preferred that the density and degree of mesh in an upper part of the backrest cushion is lower and coarser than those in a lower part thereof.

In this case, since the density and degree of mesh in the upper section of the backrest cushion is lower and coarser than those in the lower section, the upper and lower parts of the backrest cushion bend to the different extent, respectively. In detail, the upper part of the backrest cushion bends more greatly than the lower part thereof. In other words, the upper section of the backrest cushion is bowed backward in larger extent under a smaller load, as compared with the lower section thereof.

Accordingly, even in case that the lower part of the backrest cushion is designed to bend to a smaller degree in such a manner to have a function of lumber support, the upper part of the backrest cushion bends to a greater degree, enabling a user to feel comfortable to sit on.

Further, since the lower part of the backrest cushion is a high-density portion, the lower part of the front-side backrest cushion with which a user's waist continually comes into contact is strengthened with less fear of wearing out, even used over the long term.

It is preferred that the side frames are folded in such a manner as to protrude their lower parts forwards; and that an upper backrest cushion located upper than the folded portions of the side frames has density lower than a lower backrest cushion located lower than the folded portions of the side frames.

In this case, since the side frames are folded in such a manner as to protrude their lower parts forwards and further the lower backrest cushion located lower than the folded portions of the side frames has higher density, it is possible to enhance the lumber support effects for supporting the vicinity of a user's waist. Moreover, the upper backrest cushion is caused to bend greatly, thereby permitting the user to feel comfortable to sit on.

It is preferred that intermediate portions of both side frames are linked to each other by an intermediate frame curved backwards in an arc shape in plan view, thereby allowing a rear-side backrest cushion to expand backwards.

In this case, since intermediate frame links both side frames to each other, with being curved backwards in an arc shape in plan view, thereby allowing a rear-side backrest cushion to expand backwards, the front-side and rear-side of the backrest cushion separate from each other. Thus, in case that the user reclines to the backrest, only the front-side of the backrest cushion bends backwards.

As a result, the front-side backrest cushion is allowed to bend backward to a greater degree with fewer load, thereby not only permitting the chair to be comfortable to sit on, but also permitting the backrest to look voluminous and thus to have good appearance.

It is preferred that the side frames are folded to protrude their lower parts forwards; and that intermediate portions of the side frames located upper than the folded portions are linked to each other by the intermediate frame.

In this case, since the front-side and rear-side of the backrest cushion separate from each other to a greater degree and in the vertically broader area, the user's entire back is comfortably supported.

It is preferred that the upper frames are curved backwards in an arc shape in plan view.

In this case, since the front-side and rear-side of the backrest cushion separate from each other to a greater degree and in the vertically broader area, the user's entire back is comfortably supported.

In addition, the backrest looks voluminous as a whole and thus has good appearance.

It is preferred that an adaptation device for an optional member attachable to a rear side of the backrest is disposed at a central portion of the intermediate frame in the rightward/leftward direction.

In this case, with use of the intermediate frame, an optional member is allowed to attach to a rear side of the backrest It is preferred that the back frame includes a back frame body and protection members which are attached to both outer surfaces of the side frames in the back frame body and are made of material softer than that of the back frame body.

In this case, since the back frame includes protection members which are attached to both outer surfaces of the side frames in the back frame body and are made of material softer than that of the back frame body, even in case that the side portion of the backrest cushion, which is located at the side of the back frame body and covered with the protection member, frictions other fixtures and/or collides therewith via the protection member, the backrest cushion does not happen to be damaged.

Moreover, in case that the back frame collides with other fixtures, the protection member plays a role as a cushion, absorbs the external force and dampens the shock, thereby keeping the fixtures from being damaged.

It is preferred that the protection members include inwardly folded portions covering at least outer surface of the connection corners where both side frames meet the upper frame.

In this case, since even the outer surface of the connection corners where both side frames meet the upper frame is covered with the protection member, it is also possible to prevent the right and left connection corners located in the upper backrest from being damaged.

It is preferred that an elongate groove is formed to extend longitudinally in one of the protection member and the back frame body and that an elongate projection is formed in the other of the protection member and the back frame body to complement and to fit to the elongate groove.

In this case, the protection member is allowed to be located and fastened easily and securely to the back frame body without using the bolts, etc.

It is preferred that the back frame body includes the portion for receiving the protection member and indented to the extent of the thickness of the protection member.

In this case, since the outer side surface of the protection member is coplanar with that of the back frame body, the backrest has good appearance.

To achieve the first object, the present invention provides an adaptation device for adapting a backrest of the chair characterized in that a recess is formed to open rearwards and downwards in the lower frame to be covered with non-translucent part of the backrest cushion according to any one of claims 1 to 4; that laterally facing portions in a rear-side lower ends of the recess are linked by a connection bar laterally extending to be integrated with the lower frame; that a connection member is fitted and fixed to the recess in such a manner that a rear-side lower edge of the connection member is adjacent to an upper surface of the connection bar; that a plurality of fitting grooves which respectively extends in the upward/downward direction and of which lower end opens downwardly are formed to face to each other in the rear surface of the lower frame within the recess and in the front surface of the connection member; and that a pair of facing fitting grooves receives therebetween an erected portion of the backrest support adapter.

In this adaptation device, concealed from sight are the elements such as the recess formed in the rear side lower part of the lower frame, the connection member fitted and secured to the recess, the erected portion of the backrest supporting adapter mounted to the connection member and the like since these elements are covered with non-translucent portion of the backrest cushion. Thus, the appearance of the backrest improves.

Further, the erected portions are fitted to the fitting grooves formed between the facing surfaces of the recess and the connection member. Furthermore, the connection plate which has linked both erected portions with each other is caused to be interposed between the rear surface of the recess and the front surface of the connection member. Resultantly, it is possible to simplify the structure of the connection member. Additionally, a two-half type die is allowed to use for molding the connection member, thereby allowing the production cost to save.

Besides, in case that the connection member is attached within the recess of the lower frame, while the rear-side lower end of the connection member is securely abutted to the upper surface of the connection bar located at the lower edge of the lower frame, the worker is permitted to tighten the bolt. Thus, the attachment working for the connection member is simple and the number of steps for assembling is allowed to decrease. This also leads to the cost reduction.

Additionally, the connection member is supported by the connection bar. Therefore, even in case that a bolt loosens, the connection member is prevented from wobbling up and down.

It is preferred that the pair of facing grooves is formed respectively in the right and left sides to receive the right and left erected portion of the backrest support adapter and that the facing surfaces of the connection member and the recess receive therebetween a connection plate which links the facing surfaces of the right and left erected portions to each other.

In this case, since the facing surfaces of the right and left erected portions are linked to each other by the connection plate and in turn this connection plate is interposed between the lower frame and the connection member, the attachment strength of the lower frame and the backrest support adapter, particularly bending strength in the frontward/rearward direction increases.

It is preferred that a cross section of the facing fitting grooves substantially complement the outer shape of the erected portion of the backrest support adapter.

In this case, since the erected portion of the backrest support adapter is fitted to the fitting groove adequately without wobbling, the lower frame is allowed to be stably attached to the backrest support adapter.

It is preferred that an elastic interlock piece is formed in either the lower frame or the connection member to have a hook protruding from a tip of the interlock piece and elastically engageable with an engagement part of the connection plate in case of the lower frame being mounted to the backrest support adapter.

In this case, the hook automatically interlocks with the engagement part of the connection plate only by fitting the erected portion of the backrest support adapter to the lower frame, without using any securing means such as bolts. Thus, the lower frame is prevented from being detached from the backrest support adapter.

BEST MODE FOR CARRYING OUT THE INVENTION

Figure 1:
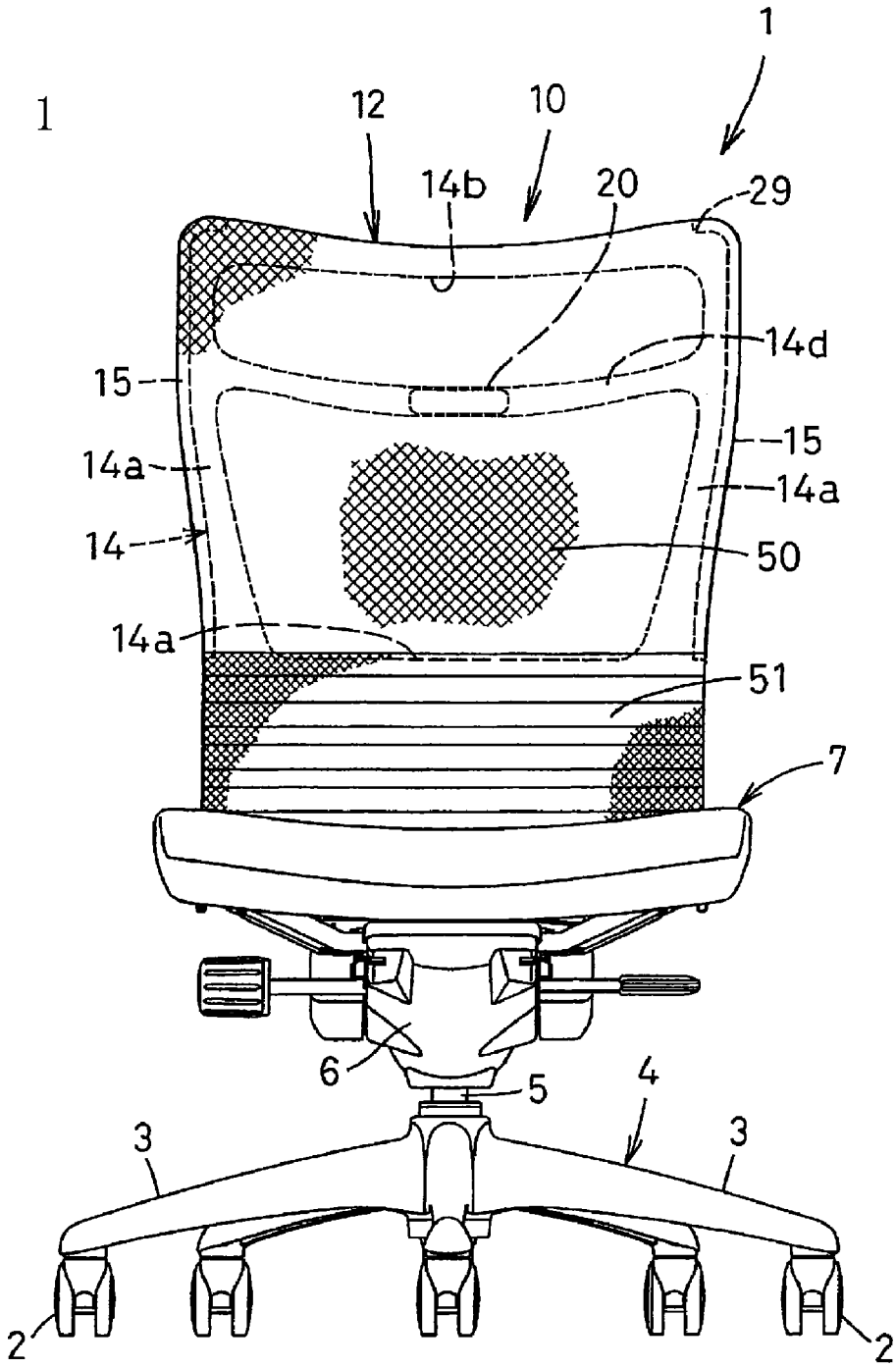
FIG. 1 a front view showing a chair having a backrest cushion and its attachment device in accordance with a first embodiment of the present invention.
Figure 2:
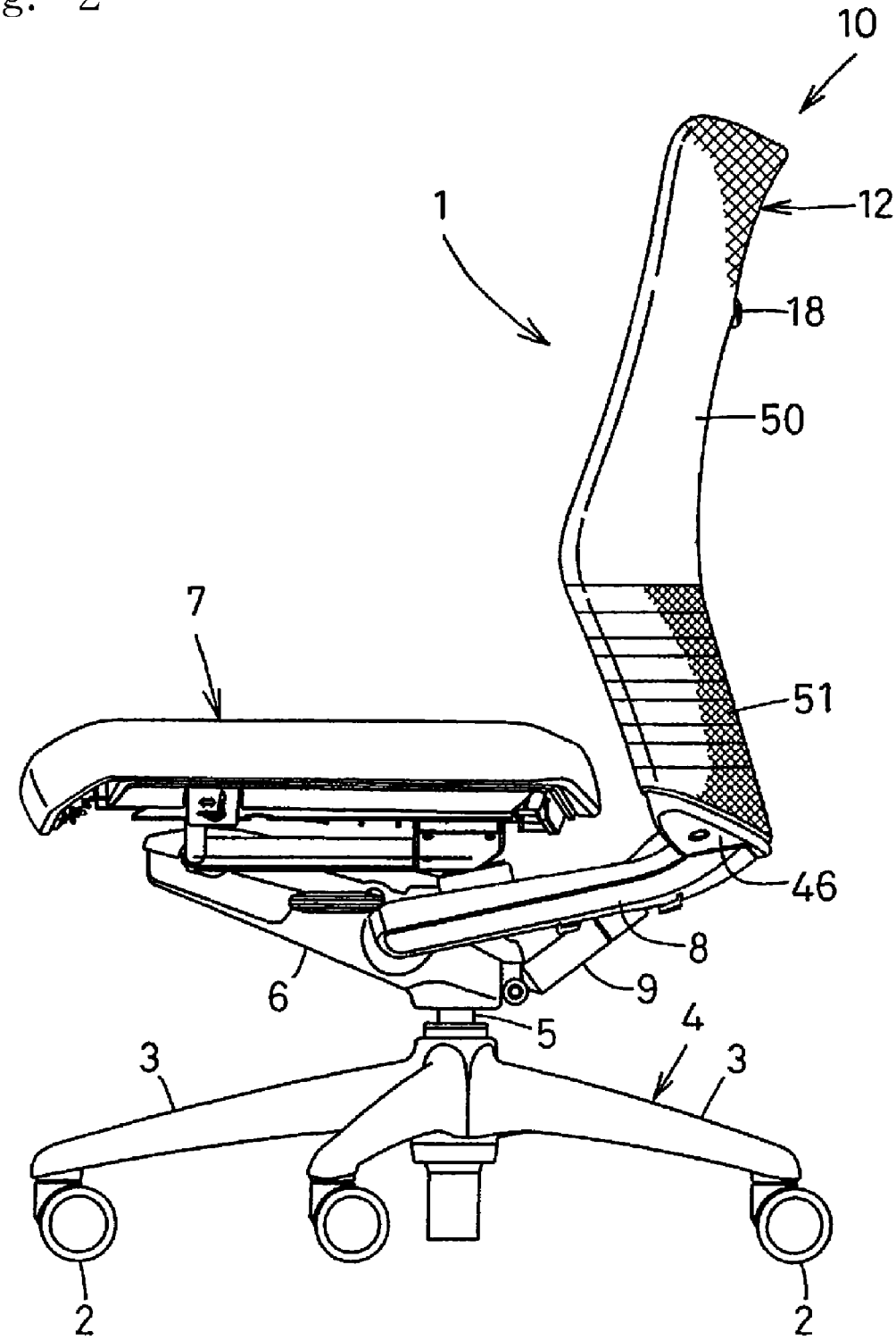
FIG. 2 a side view showing the same.
Figure 3:
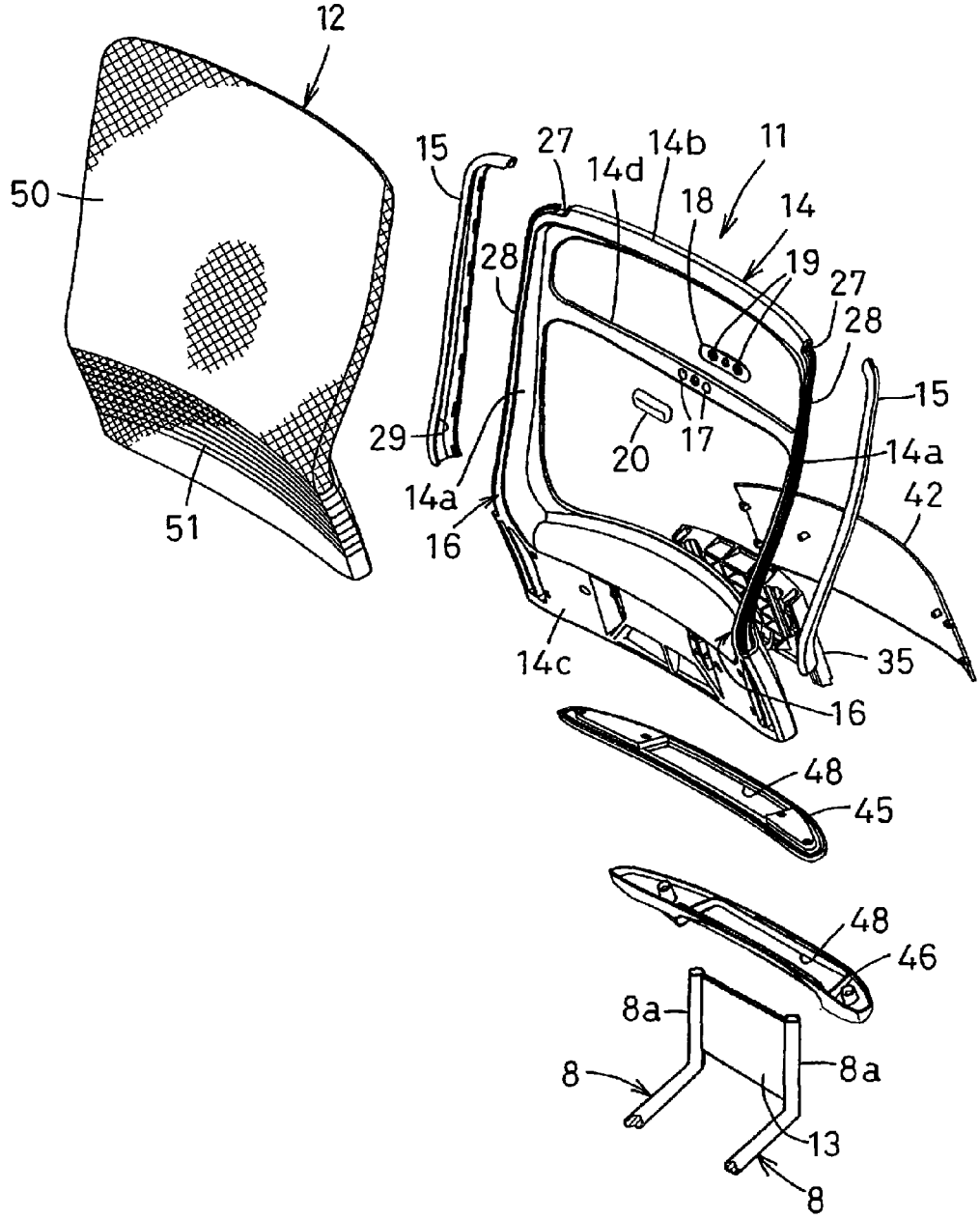
FIG. 3 an exploded perspective view showing a backrest of the same chair viewed from a front side.

One of the embodiments in accordance with the present invention will be described hereinafter with reference to the accompanying drawings. FIG. 1 is a front view showing a chair where a backrest of the present invention is applied. FIG. 2 is a side view showing the same chair. FIG. 3 is an exploded perspective view showing a backrest of the same chair viewed from a front side. FIG. 3 is an exploded perspective view showing a backrest of the same chair viewed from a rear side.

Referring to FIGS. 1 to 3, a chair 1 is composed of a leg body 4 consisting of five leg sticks 3 each extending radially and having a caster 2 on its tip; a leg pole 5 extending vertically at a center of the leg body 4 which is allowed to expand by means of a gas spring (not shown) included thereinside, a support base 6 fixed to an upper end of the leg pole 5; a seat body 7 attached to an upper part of the support base 6; two backrest support adapters 8 attached to articulate with respect to both sides of the support base 6; and a backwardly tiltable backrest 10 while urged to return by a gas spring 9 interposed between a rear end of the support base 6 and the backrest supports adapters 8.

The backrest 10 comprises a back frame 11 and a baggy stretchable backrest cushion 12 which is inverted to open downwards and is adapted to cover an entire back frame 11 except its lower end. The backrest cushion 12 may be composed of two stretchable sheets arranged back and forth and adhered or stitched to each other at their facing peripheries in such a manner as to be baggy.

Figure 4:
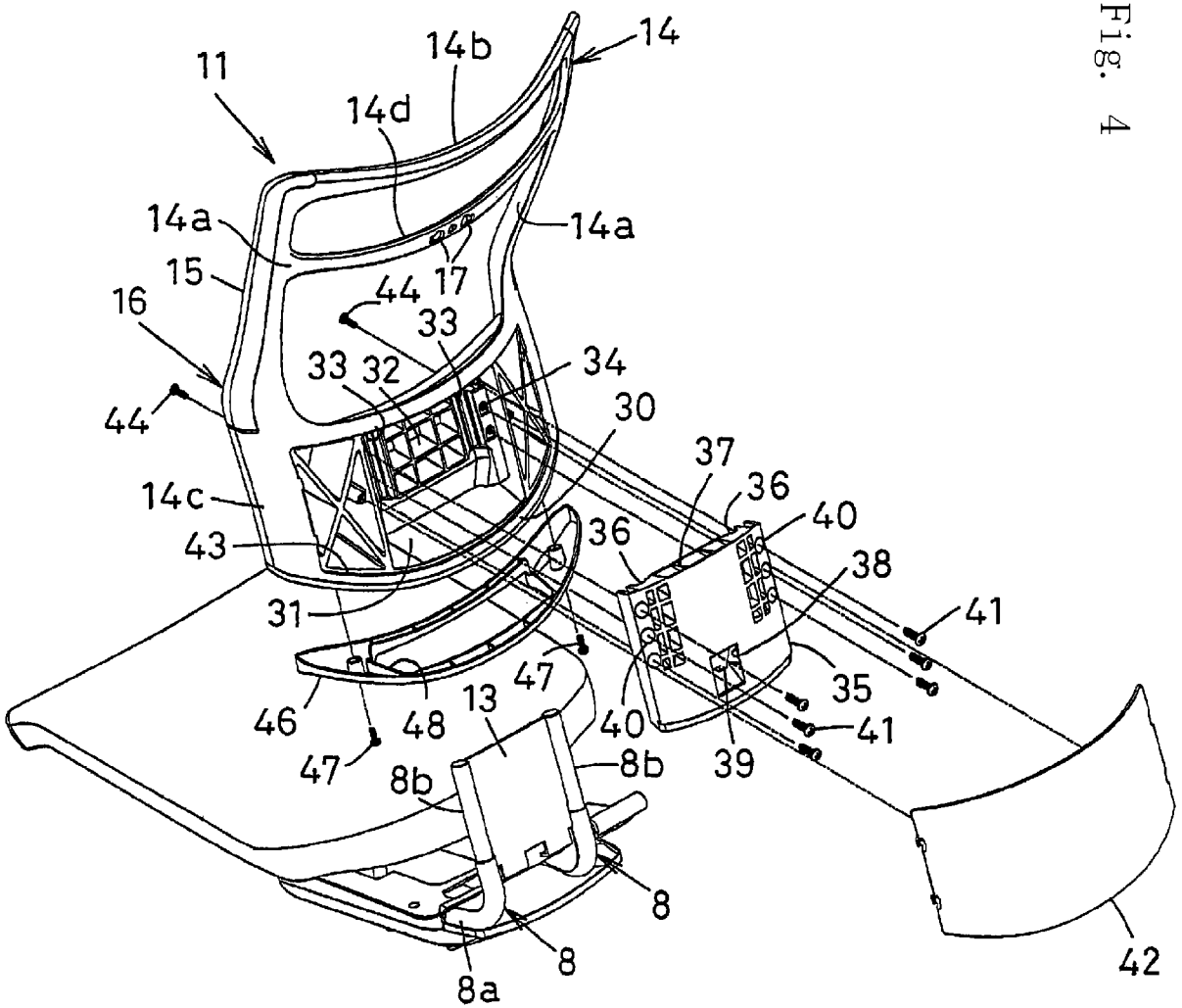
FIG. 4 an exploded perspective view showing the same backrest viewed from a rear side.
Figure 5:
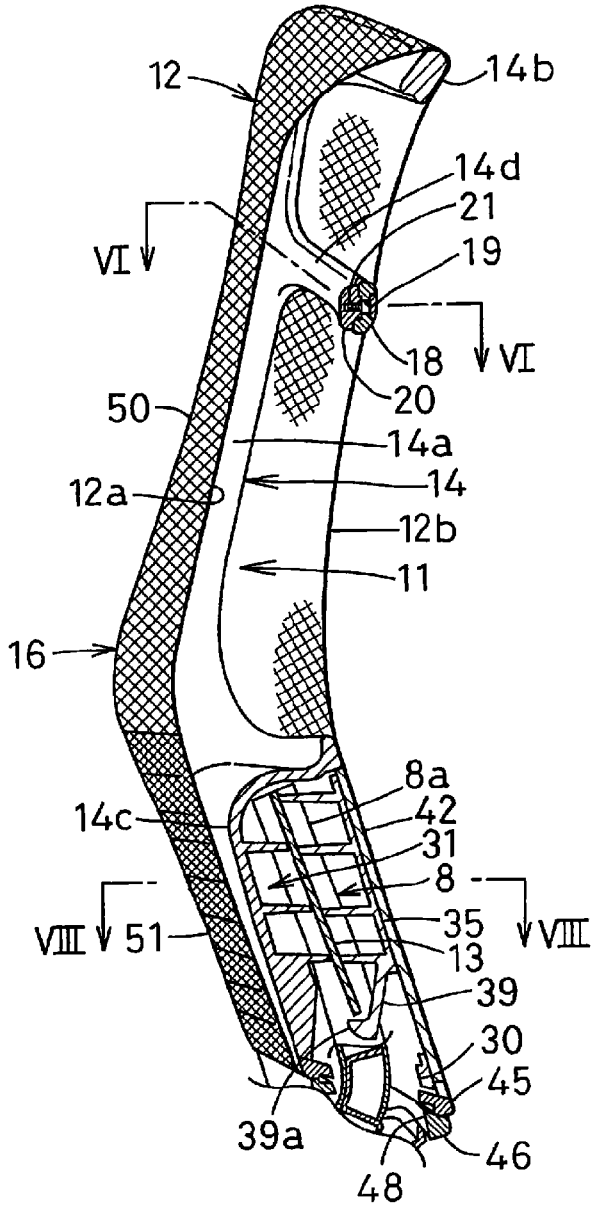
FIG. 5 an elevational enlarged side view of a central part of the same backrest.

Referring to FIGS. 3 to 5, a pair of backrest support adapters 8, 8 separated laterally from each other is L-shaped viewed from a lateral side, protruding frontwards, in such a manner that their front ends are allowed to articulate with respect to the support base 6. On the other hand, their rear ends are folded upwardly to form erected portions 8*b*, 8*b* which are designed to be positioned rearward and upward with respect to the seat body 7. The surfaces of both erected portions 8*b*, 8*b* facing to each other are linked via a connection plate 13.

The back frame 11 includes a back frame body 14 made of hard synthetic resin material; and a pair of right and left protection members 15, 15 made of material such as rubber, elastomer, soft plastic and the like softer than that of a back frame body 14.

The back frame body 14 includes right and left side frames 14*a*, 14*a*, extending in the upward/downward direction; an upper frame 14*b* extending laterally and linking upper ends of both side frames 14*a*, 14*a* to each other; and a lower frame 14*c* extending laterally and linking lower ends of both side frames 14*a*, 14*a* to each other. These frames 14*a*, 14*b*, 14*c* are formed to be integral in a rectangular shape viewed from a front side, being slightly narrower at its lower part. Further, between the upper frame 14*b* and the lower frame 14*c*, an intermediate frame 14*d* extends laterally and is integrated into the side frames 14*a*, 14*a*, allowing their intermediate portions to link to each other.

The right and left side frames 14*a*, 14*a* are folded in such a manner that the respective intermediate portion 16 in the proximity to a user's waist, i.e. a portion slightly lower with respect to a central portion in the upward/downward direction (called a folded portion 16 hereinafter) protrudes frontwards to a small degree viewed from a lateral side. Both of the upper frame 14*b* and the lower frame 14*c* are curved slightly rearwards in an arc shape.

Referring to FIGS. 3 to 5, the intermediate frame 14*d* is positioned considerably upwards from the folded portions 16 of side frames 14*a*, 14*a* and relatively close to the upper frame 14*b*. In addition, the intermediate frame 14*d* has a plate-like shape with a predetermined height in the upward/downward direction.

Figure 6:
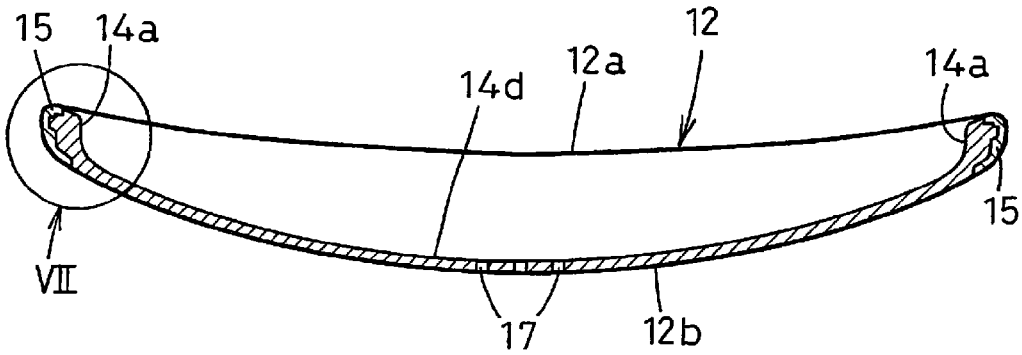
FIG. 6 a horizontal enlarged cross section taken along the line VI-VI in FIG. 5.
Figure 7:
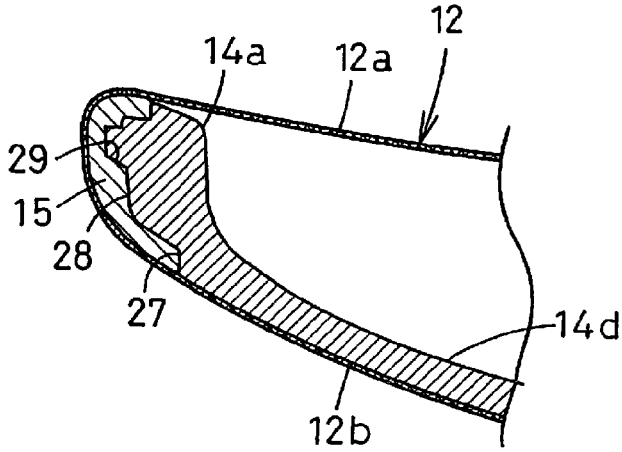
FIG. 7 an enlarged view of the encircled part VII in FIG. 6.
Figure 8:
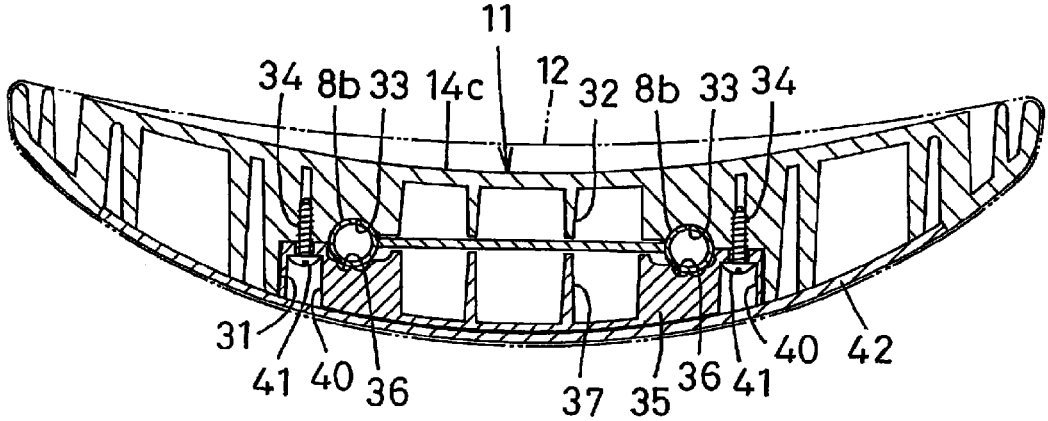
FIG. 8 a horizontal enlarged cross section taken along the line VIII-VIII in FIG. 5.

Referring to FIG. 6 which is a horizontal cross section of the intermediate frame 14*d* (none of accessories attached thereto are shown), a central portion in a lateral direction of the intermediate frame 14*d* is curved considerably rearward in an arc shape with respect to the side frames 14*a*, 14*a*. Thus, as described later, in case that a back frame 11 is covered with a baggy stretchable backrest cushion 12, a considerably large space is formed between facing surfaces of a front side cushion 12*a* and a rear side cushion 12*b*.

The central portion in a lateral direction of the intermediate frame 14*d* has a plurality of attachment holes 17 passing therethrough in the forward/rearward direction, allowing an optional member to be attached.

This optional member may be a label, a hanger, etc. In the present embodiment, a label 18 is attached. The label 18 is attached to a rear surface of the intermediate frame 14*d* by inserting an attachment bolt 21 (see FIG. 5) from backward into an attachment hole 19 of the label 18 and further into an attachment hole 17 of the intermediate frame 14*d* to mate with a threaded hole (not shown) formed in an attachment plate 20 arranged at a front side of the intermediate frame 14*d*.

Referring to FIGS. 3 to 7, indented elongate regions 27, 27 are formed over the lateral outer surfaces of the back frame body 14 from the upper connection corners where the upper frame 14*b* meets the right and left side frames 14*a*, 14*a* down to the vicinity of the folded portions 16, 16 in the side frames 14*a*, 14*a*. Elongate projections 28, 28 are integrally formed longitudinally in the lateral sides of the indented elongate regions 27, 27 in such a manner that their substantial front sides are wider than other sides.

The foregoing protection members 15, 15 are fitted to above indented elongated regions 27, 27. The protection member 15 is long enough to cover the indented elongated region 27. On the other hand, the protection member 15 is almost as wide as the outer surface of the side frame 14*a*. In the inner surface of the protection member 15 a groove 29 is formed longitudinally.

The shape of the elongate projection 28 in the side frame 14*b* complements the groove 29 of the protection member 15 such that they are securely adjacent to each other. Additionally, the depth of the indented elongate region 27 is substantially equal to the thickness of the protection member 15 such that the outer surface of the back frame body 14 may be coplanar with that of the protection member 15 in case of the protection member 25 being attached to the indented elongate region 27.

The grooves 29, 29 formed in the right and left protection member 15, 15 are elastically transformed to widen outwardly and then are fitted to the elongate projections 28, 28 formed in both side frames 14*a*, 14*a* of the back frame body 14, thereby allowing both protection member 15, 15 to be attached to both sides of the back frame body 14.

While the elongate projection 28 is formed in the back frame body 14 and the groove 29 is formed in the protection member 15 in above embodiment, it is allowed that they are formed conversely.

Further, the protection member 15 may be secured to the groove 29 by way of a bolt, adhesion, etc.

Referring to FIGS. 3 to 5, the central portion of a rear side of the lower frame 14 is concaved forward, thereby forming a rectangular recess 31 which faces rearward and downward, while a connection bar 30 in an arc shape is left to link the rear-side low ends of the lower frame 14 with each other.

Numeral 32 denotes a reinforcement grid-like rib facing rearward.

In both sides of a rear surface of the recess 31, fitting grooves 33, 33 with a semicircular cross section in plan view is formed to extend in the upward/downward direction and to open rearward and downward. The cross sections of both fitting grooves 33 substantially complement the profile of erected portions 8*b* of backrest support adapters 8. In other words, the radius of curvature of the fitting groove 33 is the same as the one of the erected portion 8*b*.

In the respective outer side of the right and left fitting grooves 33 formed on the rear surface of the recess 31, a plurality of (three) threaded holes 34 arrayed in the upward/downward direction is formed to face rearwards.

Numeral 35 denotes a connection member. This connection member 35 is in a rectangular shape and thick enough to be fitted suitably to the recess 31 from backward. The rear surface is curved in an arc shape with a curvature as substantially great as that of the rear surface of the lower frame 14*c*.

In the right and left sides on a front surface of the connection member 35, fitting groove 36, 36 are concaved rearward in an arc shape in plan view in such a manner as to extend in the upward/downward direction and to open forward, upward and downward. The cross sections of both fitting grooves 33 substantially complement the profile of erected portions 8*b* of backrest support adapters 8, which is similar to the case of fitting groove 33. In addition, in case that the connection member 35 is fitted to the recess 31 of the lower frame 14*c*, both fitting grooves 36 respectively face the fitting grooves 33 positioned in the right and left sides of the recess 31.

Numeral 37 denotes a reinforcement grid-like rib facing forward.

Referring to FIG. 5, a rectangular hole 38 is formed in a lower central portion in the rightward/leftward direction of the connection member 35. An elastic interlock piece 39 hangs obliquely frontward from an upper edge of this hole 38, which is integral therewith. At the lower end of this interlock piece 39, a hook 39*a* is integrally formed to extend obliquely forward and upward. This hook 39*a* is allowed to elastically interlock with a lower edge's central part of the connection plate 13 which links the facing surfaces of the erected portions 8*b* to each other, in case that the backrest 10 is attached to the right and left backrest support adapters 8.

At both sides of the connection member 35, a plurality of (three) stepped holes 40 arrayed in the upward/downward direction is formed to correspond to above respective threaded hole 34 formed in the lower framed 14*c*. A bolt 41 for fastening the connection member 35 is inserted into the respective stepped hole 40 from backward.

Numeral 42 denotes a back cover made of synthetic resin which is fitted to a concaved step 43 formed in the lower frame 14*c* in such a manner as to cover the connection member 35. This back cover bends in an arc shape with the same curvature as the rear surface of the lower frame 14.

Hereinafter, it will be described how the backrest support adapter 8 is attached to the back frame 11.

In the first place, the connection member 35 is fitted to the recess 31 formed in a rear side of the lower frame 14, in such a manner that its rear lower end is abuttedly supported by the upper surface of the connection bar 30. Then, the bolts 41 inserted into the stepped holes 41 at the both sides of the connection member 35 is tightened to mate with the right and left threaded holes 34 formed at rear surface of the lower frame 14*c*, allowing the connection member 35 to be fastened within the recess 31 in the lower frame 14*c*.

In the next place, the back cover 42 is fitted to the concaved step 43 formed in a rear surface of the lower frame 14*c* and then is fastened by the right and left two bolts 44, 44 inserted from a front side in such a manner as to cover the connection member 35.

Subsequently, a baggy backrest cushion 12 is caused to cover the back frame 11 from upside. Then, the lower edge of this backrest cushion 12 is secured to the lower surface of the backrest frame body 14 by tacking, etc. Further, the lower edge of the backrest cushion 12 is confined by the lower backrest cover 46, allowing the backrest cushion to stretch over the back frame 11 with a predetermined tension In the next place, the backrest 10 is caused to fall and to be mounted to the erected portions 8*b* of the right and left backrest support adapters 8, which are inserted into openings 48 formed both in the backrest lower cover 46 and a bottom plate 45. Resultantly, the right and left backrest support adapters 8 are fitted into the fitting grooves 33, 36 respectively formed on the rear surface of the recess 31 in the lower frame 14*c* and on the front surface of the connection member 35, in such a manner as to face to each other. At the same time, the connection plate 13 positioned between both erected portions 13 is caused to be interposed between the rear surface of the recess 31 and the front surface of the connection member 35.

In this case, the hook 39*a* of the elastic interlock piece 39 formed in the connection member 35 elastically interlock with an lower end of the connection plate 13, thereby preventing the backrest 10 from being detached from the backrest support adapters 8 (see FIG. 5).

As shown in FIGS. 3 and 5, above backrest cushion 12 is formed to be baggy which invertedly opens downward. Additionally, this backrest cushion 12 is made of high-tension and stretchable synthetic resin such as polyamide fiber, polypropylene fiber and the like which is knitted mesh-like or woven. The size of the backrest cushion 12 is preliminarily determined in such a manner that the adequate tension is imparted to the backrest cushion 12 in case of this covering the back frame 12.

The portion in the backrest cushion 12 for supporting the user's back, i.e. the portion located upper than the folded portion 16 of the side frame 14*a* is a low-density portion 50 with loose mesh such that it is air-permeable and translucent. On the other hand, the portion of the backrest cushion 12 for supporting the user's waist (i.e. the portion located lower than the folded portion 16) is a high-density portion 51 which is with fine mesh and non-translucent, such that concealed from sight are the elements such as the recess 31 formed in the rear side lower part of the lower frame 14*c*, the lower backrest cover 42, the backrest supporting adapter 8, the attachment portion of the backrest support adapters 8, etc.

In this embodiment, on one hand, the portion of the backrest cushion 12 located upper than the folded portion 16 is a low-density portion 50. On the other hand, the portion of the backrest cushion 12 located lower than the folded portion 16 is a high-density portion 51. Accordingly, the tension in the upper portion of the backrest cushion 12 is smaller than that in the lower portion, thereby causing the upper portion of the front-side backrest cushion 12*a* to bend backwards more greatly than the lower portion of the front-side backrest cushion 12*a*.

In case that the backrest cushion 12 is attached, the upper frame 14*b*, lower frame 14, and intermediate frame 14*d* bends are moderately curved backward in an arc shape. Thus, the rear-side backrest cushion 12*b* expands backward to have a convexly curved surface so that a bulky space is formed between both facing surfaces of the front-side backrest cushion 12*a* and the rear-side backrest cushion 12*b*.

Consequently, the front-side backrest cushion 12*a* is allowed to bend backward maximally, thereby not only permitting the chair to be comfortable to sit on, but also permitting the backrest to look voluminous and thus to have good appearance.

As explained hereinbefore, according to the backrest 10 of above embodiment, a user does not feel sweaty at his back because a portion of the backrest cushion 12 located upper than the folded portion 16 of the right and left frame 14*a*, 14*a* is a low-density portion 50 which is air-permeable and translucent.

Additionally, since a portion of the backrest cushion 12 located lower than the folded portion 16 of the right and left frame 14*a*, 14*a* is a high-density and non-translucent portion 51, allowing the elements such as the recess 31 formed in the rear surface of the lower frame 14*c*, the lower backrest cover 42, the attachment portion of the backrest support adapters 8 and the like to conceal from sight.

Further, since the lower part of the backrest cushion 12 is a high-density portion 51, the lower part of the front-side backrest cushion 12*a* with which a user's waist continually comes into contact is strengthened with less fear of wearing out.

Besides, whereas the upper portion of the backrest cushion 12 is a low-density portion 50, the lower part of the backrest cushion 12 is a high-density portion 51. Therefore, the upper part and the lower part of the front-side backrest cushion 12*a* bend with the extent different from each other. In detail, the upper part of the front-side backrest cushion 12*a* bends more greatly than the lower part. In other words, the upper part of the front-side backrest cushion 12*a* bends backward greatly with fewer loads, compared with the lower part.

Accordingly, even in case that the lower part of the backrest cushion 12 is designed to bend to a smaller degree in such a manner to have a function of lumber support, the upper part of the backrest cushion 12 bends to a greater degree, enabling a user to feel comfortable to sit on.

According to the backrest 10 in above embodiment, the protection member 15, 15 which is made of material softer than that of the back frame body 14, is attached to the outer side surface of the right and left side frame 14*a*, 14*a* as well as the connection corners for the upper frame 14*b* in the back frame body 14 made of hard material. Resultantly, in case that the side portion of the backrest cushion 12, which is located at the side of the back frame body 14 and covered with the protection member 15, frictions other fixtures and/or collides therewith via the protection member 15, the backrest cushion 12 does not happen to be damaged.

Moreover, in case that the back frame 11 collides with other fixtures, the protection member 15 plays a role as a cushion, absorbs the external force and dampens the shock, thereby keeping the fixtures from being damaged.

In the attachment device for the backrest described in above embodiment, the connection member 35 is secured within the recess 31 formed in the rear surface of the lower back frame 11. Then, the erected portions 8*b*, 8*b* are fitted to the fitting grooves 33, 33 formed between the facing surfaces of the recess 31 and the connection member 35. Furthermore, the connection plate 13 which has linked both erected portions 8*b*, 8*b* with each other is caused to be interposed between the rear surface of the recess 31 and the front surface of the connection member 35. Resultantly, it is possible to simplify the structure of the connection member 35. Additionally, a two-half type die is allowed to use for molding the connection member 35, thereby allowing the production cost to save.

In case that the connection member 35 is attached within the recess 31 of the lower frame 14*c*, while the rear-side lower end of the connection member 35 is securely abutted to the upper surface of the connection bar 30 located at the lower edge of the lower frame 14, the worker is permitted to tighten the bolt. Thus, the attachment working for the connection member 35 is simple and the number of steps for assembling is allowed to decrease. This also leads to the cost reduction.

Additionally, the connection member 35 is supported by the connection bar 30. Therefore, even in case that a bolt loosens, the connection member 35 is prevented from wobbling up and down.

In above embodiment, the hook 39*a* which protrudes from the elastic interlock piece 39 formed in the connection member 35, is caused to elastically interlock with the lower edge of the connection plate 13, thereby preventing the backrest 10 from being detached from the backrest support adapter 8. The interlocking area may be an interlocking protrusion, or an interlocking hole formed in the lower end part of the connection plate 13, etc.

Contrary to above embodiment, the elastic interlock piece 39 may hang from the rear side of the recess 31 in the side frame 14*b* and in turn the hook 39*a* may protrude backward.

What is claimed is:

1. A backrest of a chair comprising:

a back frame including:

right and left side frames extending in upward/downward directions;

an upper frame extending laterally and linking upper ends of the side frames to each other; and a lower frame attaching lower ends of the side frames to a backrest support adapter protruding upward from a rear part of a seat body in the chair;

a baggy stretchable backrest cushion which is inverted to open vertically and is knitted;

wherein an upper part of the backrest cushion is air permeable;

wherein at least a part of the lower backrest cushion covering the lower frame is non-translucent;

an adaptation device for adapting said backrest of the chair, wherein a recess is formed to open rearwards and downwards in the lower frame to be covered with said non-translucent part of the backrest cushion;

wherein laterally facing portions in said recess are linked by a connection bar laterally extending to be integrated with the lower frame;

wherein a connection member is fitted and fixed to the recess in such a manner that a rear-side lower edge of the connection member is abutted to an upper surface of the connection bar, said connection member includes a front surface and right and left sides;

wherein a plurality of fitting grooves which respectively extends in the upward/downward direction and of which lower end opens downwardly are formed to face to each other in the rear surface of the lower frame within the recess and in the front surface of the connection member; and wherein said pair of facing fitting grooves receives therebetween an erected portion of the backrest support adapter, said erected portion having an outer shape.

2. The adaptation device for adapting the backrest according to claim 1, wherein in said pair or facing grooves formed respectively in the right and left sides to receive the right and left erected portion of the backrest support adapter; that the facing surfaces of the connection member and the recess receive therebetween a connection plate which links the facing surfaces of the right and left erected portions to each other.

3. The adaptation device for adapting the backrest according to claim 1, wherein a cross section of the facing fitting grooves substantially complement the shape of the erected portion of the backrest support adapter.

4. The adaptation device for adapting the backrest according to claim 1, said adaptation device having a connection plate, wherein an elastic interlock piece is formed in either the lower frame or the connection member to have a hook protruding from a tip of the interlock piece which elastically engages with an engagement part of a connection plate in case of the lower frame being mounted to the backrest support adapter.

* * * * *